US009182739B2

(12) United States Patent
Lee et al.

(10) Patent No.: US 9,182,739 B2
(45) Date of Patent: Nov. 10, 2015

(54) ELECTROPHOTOGRAPHIC IMAGE FORMING APPARATUS

(71) Applicant: SAMSUNG ELECTRONICS CO., LTD., Suwon-si (KR)

(72) Inventors: Sang-hoon Lee, Suwon-si (KR); Young-chae Kim, Seoul (KR); Sang-jin Park, Hwaseong-si (KR); Dong-cheol Ahn, Suwon-si (KR); Ki-hyun Yoo, Suwon-si (KR); Seung-gweon Lee, Suwon-si (KR); Ho-jin Jang, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/014,626

(22) Filed: Aug. 30, 2013

(65) Prior Publication Data

US 2014/0205318 A1 Jul. 24, 2014

Related U.S. Application Data

(60) Provisional application No. 61/756,269, filed on Jan. 24, 2013, provisional application No. 61/758,970, filed on Jan. 31, 2013.

(30) Foreign Application Priority Data

Apr. 23, 2013 (KR) ..... 10-2013-0045044

(51) Int. Cl.

| | |
|---|---|
| ***G03G 21/18*** | (2006.01) |
| ***G03G 15/04*** | (2006.01) |
| *G03G 21/16* | (2006.01) |

(52) U.S. Cl.

CPC ..... *G03G 21/1853* (2013.01); *G03G 21/1647* (2013.01); *G03G 21/1821* (2013.01); *G03G 21/1857* (2013.01); *G03G 21/1633* (2013.01); *G03G 2221/1657* (2013.01)

(58) Field of Classification Search

USPC ..... 399/111, 113, 117

See application file for complete search history.

(56) References Cited

U.S. PATENT DOCUMENTS

| | | | |
|---|---|---|---|
| 5,160,964 | A | 11/1992 | Takahashi et al. |
| 6,654,581 | B2 | 11/2003 | Liu et al. |

(Continued)

FOREIGN PATENT DOCUMENTS

| | | |
|---|---|---|
| EP | 1806634 A1 | 7/2007 |
| JP | 2009-181018 | 8/2009 |

(Continued)

OTHER PUBLICATIONS

European Search Report mailed Sep. 4, 2013 in related European Application No. 13170028.8.

(Continued)

*Primary Examiner* — David Gray
*Assistant Examiner* — Michael Harrison
(74) *Attorney, Agent, or Firm* — Staas & Halsey LLP

(57) ABSTRACT

An electrophotographic image forming apparatus is provided including a body including an opening and a first coupler, a photoreceptor cartridge including a second coupler connected to the first coupler, a first gear connected to the second coupler, and a mounting portion, and attached to or detached from the body through the opening; and a development cartridge including a second gear connected to the first gear and attached or detached from the mounting portion through the opening while the photoreceptor cartridge is mounted in the body.

15 Claims, 15 Drawing Sheets

(56) References Cited

U.S. PATENT DOCUMENTS

| | | | | |
|---|---|---|---|---|
| 6,678,489 | B1 | 1/2004 | Carter et al. | |
| 6,690,903 | B2 | 2/2004 | Okabe et al. | |
| 6,873,810 | B2 | 3/2005 | Okabe et al. | |
| 7,616,907 | B2 | 11/2009 | Kim et al. | |
| 8,121,518 | B2 | 2/2012 | Sato | |
| 8,457,525 | B2 | 6/2013 | Kamimura | |
| 2003/0049046 | A1 | 3/2003 | Okabe | |
| 2004/0096240 | A1 | 5/2004 | Kim | |
| 2005/0002682 | A1 | 1/2005 | Lyu et al. | |
| 2005/0111881 | A1* | 5/2005 | Arimitsu et al. | 399/167 |
| 2005/0191090 | A1 | 9/2005 | Nishimura | |
| 2006/0257163 | A1 | 11/2006 | Sato | |
| 2007/0071496 | A1 | 3/2007 | Lee | |
| 2007/0147887 | A1 | 6/2007 | Hattori | |
| 2009/0067877 | A1 | 3/2009 | Terai | |
| 2011/0064461 | A1 | 3/2011 | Ishii et al. | |
| 2011/0091222 | A1 | 4/2011 | Kim et al. | |
| 2011/0206410 | A1* | 8/2011 | Okabe | 399/111 |
| 2011/0236060 | A1 | 9/2011 | Takagi | |
| 2014/0037330 | A1 | 2/2014 | Hiramatsu et al. | |

FOREIGN PATENT DOCUMENTS

| | | |
|---|---|---|
| JP | 2009-181027 | 8/2009 |
| JP | 2009-244555 | 10/2009 |
| JP | 2010-266893 | 11/2010 |
| JP | 2011-22616 | 2/2011 |
| JP | 2011-65185 | 3/2011 |
| JP | 4743199 | 5/2011 |
| JP | 2012-42725 | 3/2012 |
| KR | 10-2007-0087738 | 8/2007 |
| KR | 10-2011-0071440 | 6/2011 |
| KR | 10-1066103 | 9/2011 |

OTHER PUBLICATIONS

European Office Action mailed Sep. 30, 2013 in related European Application No. 13170028.8.

European Search Report mailed Sep. 4, 2013 in related European Application No. 13170061.9.

European Office Action mailed Sep. 30 in related European Application No. 13170061.9.

Office Action mailed Aug. 6, 2014 in related U.S. Appl. No. 14/021,518.

Office Action mailed Jul. 14, 2014 in related U.S. Appl. No. 13/906,582.

Extended European Search Report mailed Jun. 12, 2014 in related European Application No. 13196416.5.

European Office Action mailed Apr. 29, 2014 in related European Application No. 1317061.9.

European Office Action mailed Apr. 28, 2014 in related European Application No. 13170028.8.

Notice of Allowance mailed Feb. 2, 2015 in related U.S. Appl. No. 14/029,172.

Notice of Allowance mailed Jan. 14, 2015 in related U.S. Appl. No. 13/906,582.

European Office Action dated Mar. 10, 2015 in corresponding European Patent Application No. 13170028.8.

European Office Action dated May 5, 2015 in corresponding European Patent Application No. 13170061.9.

Office Action mailed Sep. 9, 2014 in related U.S. Appl. No. 14/029,172.

Office Action mailed Dec. 1, 2014 in related U.S. Appl. No. 13/906,587.

Office Action mailed Nov. 20, 2014 in related U.S. Appl. No. 14/021,518.

Office Action mailed Dec. 5, 2014 in related U.S. Appl. No. 14/021,518.

Korean Notice of Allowance mailed Sep. 22, 2014 in related Korean Application No. 10-2013-0045046.

Korean Notice of Allowance mailed Sep. 22, 2014 in related Korean Application No. 10-2013-0045047.

European Office Action mailed Oct. 30, 2014 in related European Application No. 13170061.9.

U.S. Final Office Action mailed Jun. 18, 2015 in co-pending U.S. Appl. No. 13/906,587.

European Office Action issued Aug. 26, 2015 in corresponding European Patent Application No. 13170028.8.

* cited by examiner

ELECTROPHOTOGRAPHIC IMAGE FORMING APPARATUS

CROSS-REFERENCE TO RELATED APPLICATIONS

This application is related to, and claims priority to, U.S. Provisional Application No. 61/756,269, filed on Jan. 24, 2013 and U.S. Provisional Application No. 61/758,970, filed on Jan. 31, 2013, in the U.S. Patent and Trademark office, and Korean Patent Application No. 10-2013-0045044, filed on Apr. 23, 2013, in the Korean Intellectual Property Office, the disclosures of which are incorporated herein by reference.

BACKGROUND

1. Field

Exemplary embodiments of the present general invention relate to an electrophotographic image forming apparatus capable of individually attaching/detaching a photoreceptor cartridge and a development cartridge.

2. Description of the Related Art

An image forming apparatus using electrophotography prints an image on a recording medium by supplying toner to an electrostatic latent image formed on a photoreceptor to form a visible toner image on the photoreceptor, transferring the visible toner image to the recording medium, and fusing the transferred visible toner image on the recording medium.

A process cartridge is an assembly of components for forming a visible toner image, and may be a consumable product that is detachable from a body of an image forming apparatus and replaceable after it's effective life is ended. An integrated process cartridge includes a photoreceptor and contains toner to be supplied to the photoreceptor. However, an amount (life) of toner included in the integrated process cartridge may be shorter than a life of the photoreceptor. Since a life of the integrated process cartridge is dependent upon the amount of toner included therein, after the toner is all used up, the integrated process cartridge has to be replaced even if the life of the photoreceptor is not expired, thereby increasing consumable product costs for a user.

To attempt to reduce consumable product costs, a separable process cartridge may be desired so that a photoreceptor cartridge including a photoreceptor and a development cartridge containing toner may be individually replaced.

SUMMARY

Additional aspects and/or advantages will be set forth in part in the description which follows and, in part, will be apparent from the description, or may be learned by practice of the invention.

According to an exemplary embodiment of the present invention, an electrophotographic image forming apparatus is provided capable of individually attaching/detaching a photoreceptor cartridge and a development cartridge to/from a body, wherein driving power is stably transmitted to the development cartridge.

According to an exemplary embodiment of the present invention, an electrophotographic image forming apparatus is provided capable of individually attaching/detaching a photoreceptor cartridge and a development cartridge to/from a body, wherein location stability of the development cartridge is improved.

According to an aspect of the present invention, an electrophotographic image forming apparatus is provided including a body including an opening and a first coupler, a photoreceptor cartridge including a second coupler connected to the first coupler, a first gear connected to the second coupler, and a mounting portion, and attached to or detached from the body through the opening, and a development cartridge including a second gear connected to the first gear, and attached to or detached from the mounting portion through the opening in a state where the photoreceptor cartridge is mounted in the body.

The photoreceptor cartridge may include a photoconductive drum on which an electrostatic latent image is formed, and the development cartridge may include a development roller for supplying toner included therein to the electrostatic latent image formed on the photoconductive drum.

Mounting and removing directions of the photoreceptor cartridge and the development cartridge may be traverse directions crossing a length direction of the photoconductive drum.

The first coupler and the first gear may be provided at a rotation shaft of the photoconductive drum.

The second gear may be provided at a rotation shaft of the development roller.

The electrophotographic image forming apparatus may include a first guide protrusion disposed on both side portions of the development cartridge, and a first accommodation portion provided at the photoreceptor cartridge and in which the first guide protrusion is accommodated, wherein the first accommodation portion may include a retreat preventing portion disposed at a removal direction of the first guide protrusion and supporting the first guide protrusion.

An angle formed by the retreat preventing portion and a line connecting centers of the first and second gears may be larger than a pressure angle of the first and second gears.

The angle formed by the retreat preventing portion and the line connecting the centers of the first and second gears may be smaller than 90°.

The electrophotographic image forming apparatus may further include a first guide rail provided at the photoreceptor cartridge and guiding the first guide protrusion to the first accommodation portion, wherein an angle formed by the retreat preventing portion and the first guide rail may be an obtuse angle smaller than 180°.

The electrophotographic image forming apparatus may include a second guide protrusion disposed at both side portions of the development cartridge, and a second accommodation portion provided at the photoreceptor cartridge and in which the second guide protrusion is accommodated, wherein the second accommodation portion may include a rotation preventing portion for supporting the second guide protrusion by being disposed at a downstream of a rotation direction of the first gear based on the second guide protrusion.

The electrophotographic image forming apparatus may further include a second guide rail for guiding the second guide protrusion to the second accommodation portion.

According to an exemplary aspect of the present invention, an electrophotographic image forming apparatus includes a body including an opening, a photoreceptor cartridge attached to or detached from the body through the opening, and comprising a photoconductive drum and a mounting portion, a development cartridge attached to or detached from the mounting portion through the opening in a state where the photoreceptor cartridge is mounted in the body, and including a development roller for supplying toner to an electrostatic latent image formed on the photoconductive drum, and a power connecting unit for sequentially connecting power from the body to the photoreceptor cartridge and the development cartridge.

The power connecting unit may include, a first coupler provided at the body, a second coupler provided at the photoreceptor cartridge, and connected to the first coupler when the photoreceptor cartridge is mounted in the body, a first gear provided at the photoreceptor cartridge and connected to the second coupler, and a second gear provided at the development cartridge and connected to the first gear when the development cartridge is mounted in the mounting portion.

The first coupler and the first gear may be provided at a rotation shaft of the photoconductive drum, and the second gear may be provided at a rotation shaft of the development roller.

The electrophotographic image forming apparatus may include a first guide protrusion disposed at both side portions of the development cartridge, and a first accommodation portion provided at the photoreceptor cartridge and in which the first guide protrusion is accommodated, wherein the first accommodation portion comprises a retreat preventing portion supporting the first guide protrusion by being disposed at a removal direction of the first guide protrusion.

The electrophotographic image forming apparatus may include a first guide rail provided at the photoreceptor cartridge and guiding the first guide protrusion to the first accommodation portion, wherein an angle formed by the retreat preventing portion and a line connecting centers of the first and second gears may be larger than a pressure angle of the first and second gears, and an angle formed by the retreat preventing portion and the first guide rail may be an obtuse angle smaller than 180°.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Figure 1:
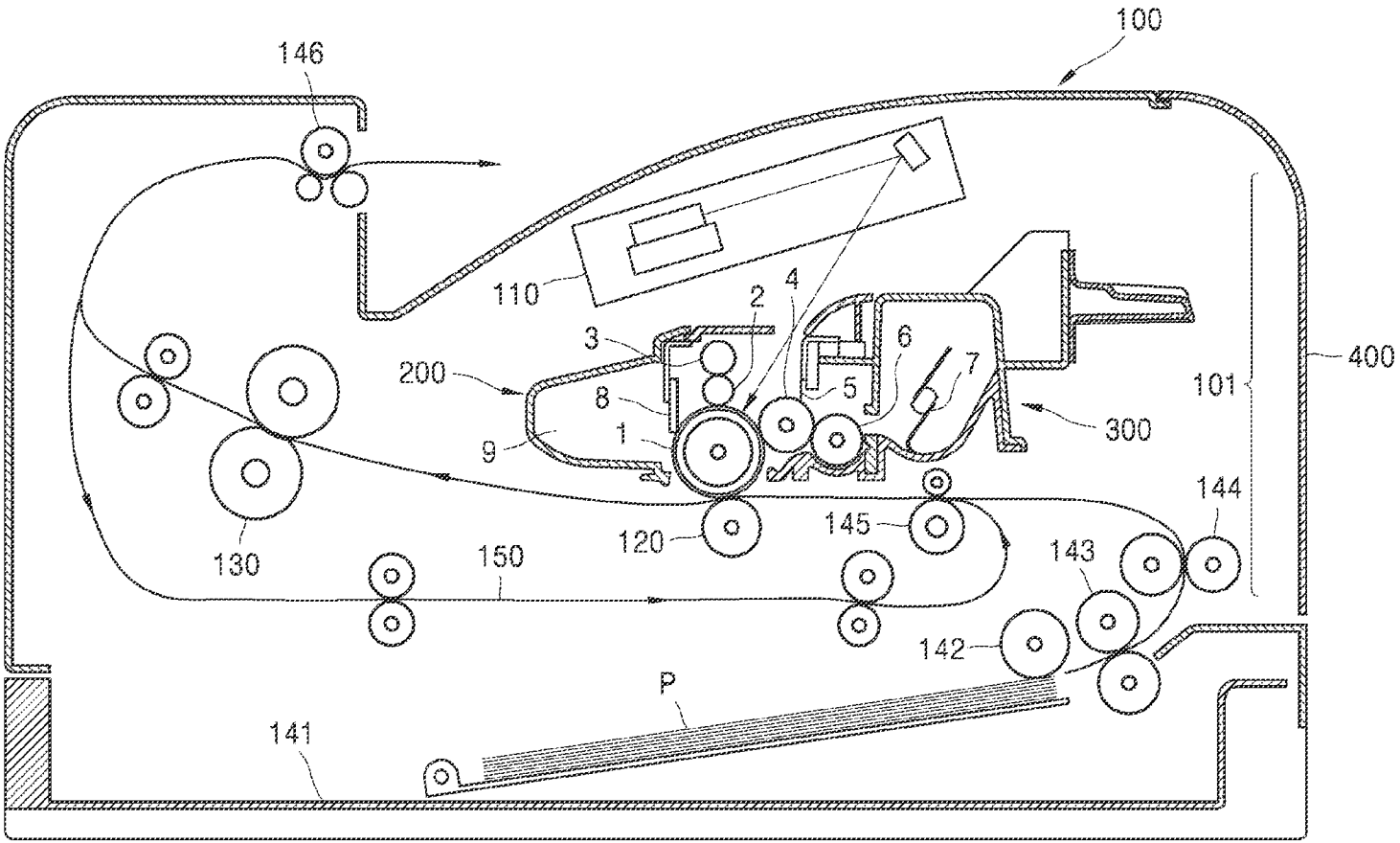
FIG. 1 is a schematic view of an electrophotographic image forming apparatus according to an embodiment of the present invention.

Exemplary embodiments of the present invention are described more fully with reference to the accompanying drawings, in which exemplary embodiments of the present invention are illustrated. In the drawings, like reference numerals denote like elements.

Figure 2:
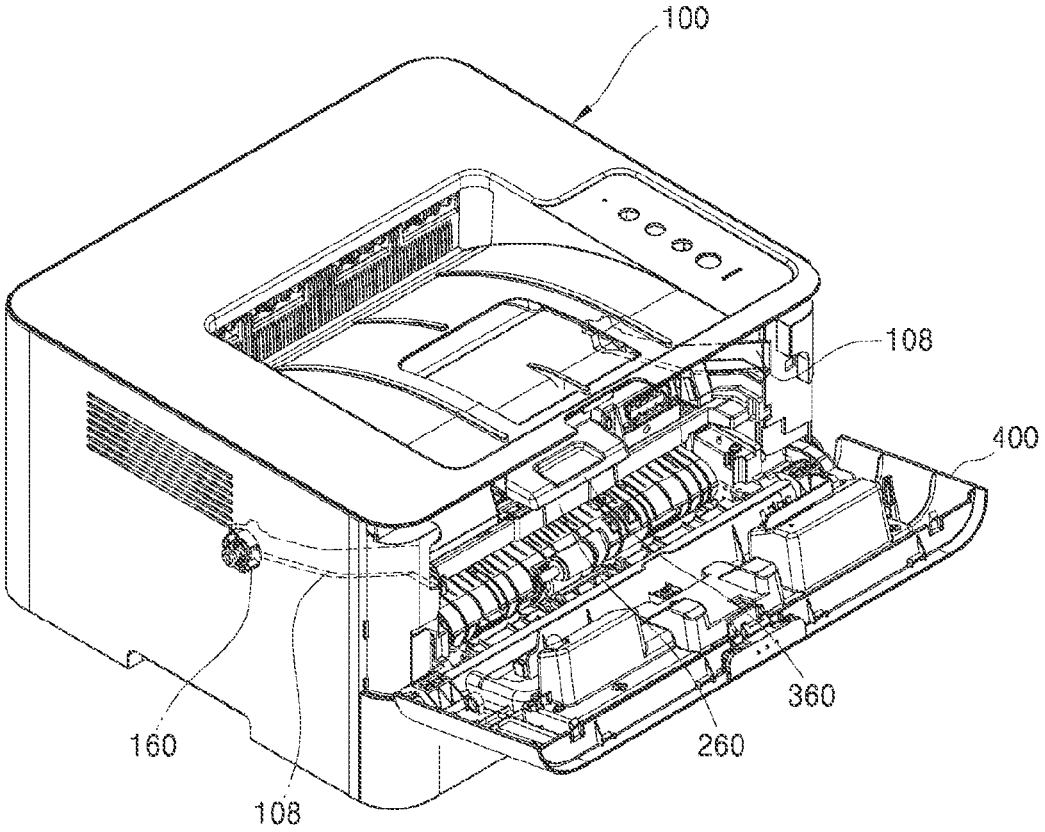
FIG. 2 is a schematic perspective view of an exemplary electrophotographic image forming apparatus according to an embodiment of the present invention.

FIG. 1 is a schematic view of an electrophotographic image forming apparatus according to an embodiment of the present invention. FIG. 2 is a schematic perspective view of an exemplary electrophotographic image forming apparatus according to an embodiment of the present invention.

Referring to FIGS. 1 and 2, a body 100, a photoreceptor cartridge 200, and a development cartridge 300 are illustrated. The body 100 includes an opening 101 providing a passage for the photoreceptor cartridge 200 and the development cartridge 300 to be mounted or removed. A cover 400 closes or opens the opening 101. The body 100 includes an exposure unit 110, a transfer roller 120, and a fusing unit 130. The body 100 includes a recording medium transfer structure for loading and transferring a recording medium P where an image is to be formed.

The photoreceptor cartridge 200 includes a photoconductive drum 1. The photoconductive drum 1 is an example of a photoreceptor, wherein an electrostatic latent image may be formed on a surface thereof, and may include a conductive metal pipe and a photosensitive layer around the conductive metal pipe. A charging roller 2 is an example of a charger for charging the photoconductive drum 1 to have uniform surface potential. A charging brush or a corona charger may be used instead of the charging roller 2. Cleaning roller 3 may be used for removing foreign materials on a surface of the charging roller 2. A cleaning blade 8 is an example of a cleaning unit for removing toner and foreign materials on a surface of the photoconductive drum 1 after a transfer process described later. A cleaning apparatus having another shape, such as a rotating brush, may be used instead of the cleaning blade 8. The toner and foreign materials removed by the cleaning blade 8 are included in a waste toner container 9.

The development cartridge 300 supplies toner included therein to an electrostatic latent image formed on the photoconductive drum 1 to develop the electrostatic latent image into a visible toner image. When a one-component development method is used, toner may be included in the development cartridge 300, and when a two-component development method is used, toner and a carrier may be included in the development cartridge 300. A development roller 4 is used to supply the toner in the development cartridge 300 to the photoconductive drum 1. A development bias voltage may be applied to the development roller 4. A regulator 5 constrains an amount of toner supplied from the development roller 4 to a development region where the photoconductive drum 1 and the development roller 4 face each other. The regulator 5 may be a doctor blade elastically contacting a surface of the development roller 4.

Figure 3A:
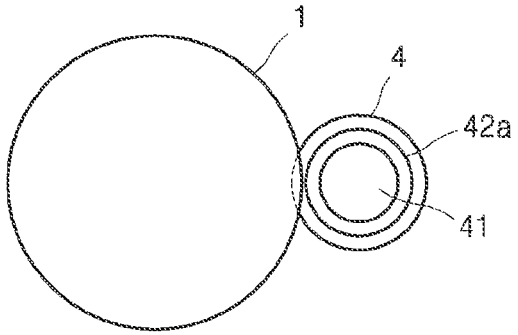
FIG. 3A is a diagram of an exemplary arrangement of a photoconductive drum and a development roller in a contact development method.
Figure 3B:
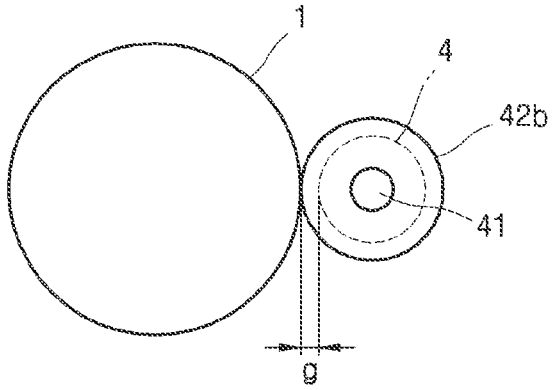
FIG. 3B is a diagram of an exemplary arrangement of a photoconductive drum and a development roller in a non-contact development method.

A one-component development method may be used in an exemplary embodiment. The one-component development method may be classified as a contact development method, wherein the development roller 4 and the photoconductive drum 1 are rotated while contacting each other, or as a non-contact development method, wherein the development roller 4 and the photoconductive drum 1 are rotated by being spaced apart from each other, e.g., in an order of dozens to hundreds of microns. FIG. 3A is a diagram of an exemplary arrangement of the photoconductive drum 1 and the development roller 4 in a contact development method. FIG. 3B is a diagram of an exemplary arrangement of the photoconductive drum 1 and the development roller 4 in the non-contact development method. Referring to FIG. 3A, in the contact development method, a gap maintaining member 42*a* having a smaller diameter than the development roller 4 may be provided, for example, on each of both ends of a rotation shaft 41 of the development roller 4. A contact amount of the development roller 4 to the photoconductive drum 1 may be constrained as the gap maintaining member 42*a* contacts the surface of the photoconductive drum 1. Referring to FIG. 3B, in the non-contact development method, a gap maintaining member 42*b* having a larger diameter than the development roller 4 may be provided on each of the both ends of the rotation shaft 41 of the development roller 4. A gap "g" between the development roller 4 and the photoconductive drum 1 may be constrained as the gap maintaining member 42*b* contacts the surface of the photoconductive drum 1. The development cartridge 300 may include a supply roller 6 for adhering the toner to the surface of the development roller 4. A supply bias voltage may be applied to the supply roller 6. The development cartridge 300 may include an agitator 7 for stirring the toner and supplying the toner towards the supply roller 6 and the development roller 4. The agitator may stir and triboelectrically charge the toner.

When a two-component development method is used, the development roller 4 may be spaced apart from the photoconductive drum 1, e.g., in an order of dozens to hundreds of microns. Although not illustrated, the development roller 4 may have a structure wherein a magnetic roller is disposed in a hollow cylindrical sleeve. The toner is adhered to a surface of a magnetic carrier. The magnetic carrier is adhered to the surface of the development roller 4 to be transferred to the development region where the photoconductive drum 1 and the development roller 4 face each other. Only the toner may be supplied to the photoconductive drum 1 according to the development bias voltage applied between the development roller 4 and the photoconductive drum 1, and thus the electrostatic latent image formed on the surface of the photoconductive drum 1 is developed into the visible toner image. The development cartridge 300 may include a transport agitator (not shown) for mixing and stirring the toner and a carrier and transporting the mixture to the development roller 4. The transport agitator may be an auger, and a plurality of the transport agitators may be provided in the development cartridge 300.

Examples of development methods of the electrophotographic image forming apparatus according to an embodiment are described, but the present invention is not limited thereto, and exemplary development methods may be variously modified and changed.

The exposure unit 110 forms the electrostatic latent image on the photoconductive drum 1 by irradiating light modulated according to image information to the photoconductive drum 1. The exposure unit 110 may be a laser scanning unit (LSU) using a laser diode as a light source, or a light-emitting diode (LED) exposure unit using an LED as a light source.

The transfer roller 120 is an example of a transfer unit for transferring a toner image from the photoconductive drum 1 to the recording medium P. A transfer bias voltage for transferring the toner image to the recording medium P is applied to the transfer roller 120. A corona transfer unit or a transfer unit using a pin scorotron method may be used instead of the transfer roller 120.

The recording media P may be picked up one by one from a loading table 141 by a pickup roller 142, and are transferred to a region where the photoconductive drum 1 and the transfer roller 120 face each other by feed rollers 143, 144, and 145.

The fusing unit 130 applies heat and pressure to an image transferred to the recording medium P so as to fuse the image on the recording medium P. The recording medium P that passed through the fusing unit 130 is discharged outside the body 100 by a discharge roller 146.

According to an exemplary embodiment, the exposure unit 110 irradiates the light modulated according to the image information to the photoconductive drum 1 to develop the electrostatic latent image. The development roller 4 supplies the toner to the electrostatic latent image to form the visible toner image on the surface of the photoconductive drum 1. The recording medium loaded in the loading table 141 may be transferred to the region where the photoconductive drum 1 and the transfer roller 120 face each other by the pickup roller 142 and the feed rollers 143, 144, and 145, and the toner image is transferred on the recording medium P from the photoconductive drum 1 according to the transfer bias voltage applied to the transfer roller 120. After the recording medium P passes through the fusing unit 130, the toner image may be fused on the recording medium P according to heat and pressure. After the fusing, the recording medium P is discharged by the discharge roller 146. When duplex printing is performed, after an imaged is printed on a front side of the recording medium P, the recording medium P is re-transferred to the region where the photoconductive drum 1 and the transfer roller 120 face each other along a reverse transfer path 150 as the discharge roller 146 is reverse-rotated. A new toner image may be transferred to and fused on a rear side of the recording medium P, and then the recording medium P having duplex images is discharged by the discharge roller 146.

The photoreceptor cartridge 200 and the development cartridge 300 are consumable products that are replaced after their lives are expired. Since lives of the photoreceptor cartridge 200 and the development cartridge 300 may be different, the photoreceptor cartridge 200 and the development cartridge 300 may be individually replaced.

A process cartridge, wherein the photoreceptor cartridge 200 and the development cartridge 300 are combined , may be mounted in, or removed from, the body 100. According to an exemplary embodiment, when only the development cartridge 300 is to be replaced, the process cartridge is removed from the body 100, the combination of the photoreceptor cartridge 200 and the development cartridge 300 is released, a new development cartridge 300 is combined to the photoreceptor cartridge 200, and the process cartridge is mounted in the body 100. Accordingly, processes for replacing the development cartridge 300 are complex. Since a weight of the process cartridge may be heavy, it may be difficult to handle the process cartridge during mounting and removing processes.

According to an exemplary embodiment, the photoreceptor cartridge 200 may be mounted in the body 100. The development cartridge 300 may be mounted in a mounting portion 201 provided in the photoreceptor cartridge 200. When removing the photoreceptor cartridge 200 and the development cartridge 300, the photoreceptor cartridge 200 may be removed from the body 100 after the development cartridge 300 is removed from the mounting portion 201. Accordingly, since the photoreceptor cartridge 200 and the development cartridge 300 may be individually mounted in or removed from the body 100, it is relatively easy to replace the photoreceptor cartridge 200 or the development cartridge 300. Since the photoreceptor cartridge 200 and the development cartridge 300 are individually handled during the mounting and removing processes, user convenience may be improved as a burden of weights may be reduced.

Hereinafter, "front" is defined as a mounting direction A1 of the photoreceptor cartridge 200 and the development cartridge 300, and "rear" is defined as an opposite direction of the mounting direction A1, i.e., a removal direction A2.

Figure 4:
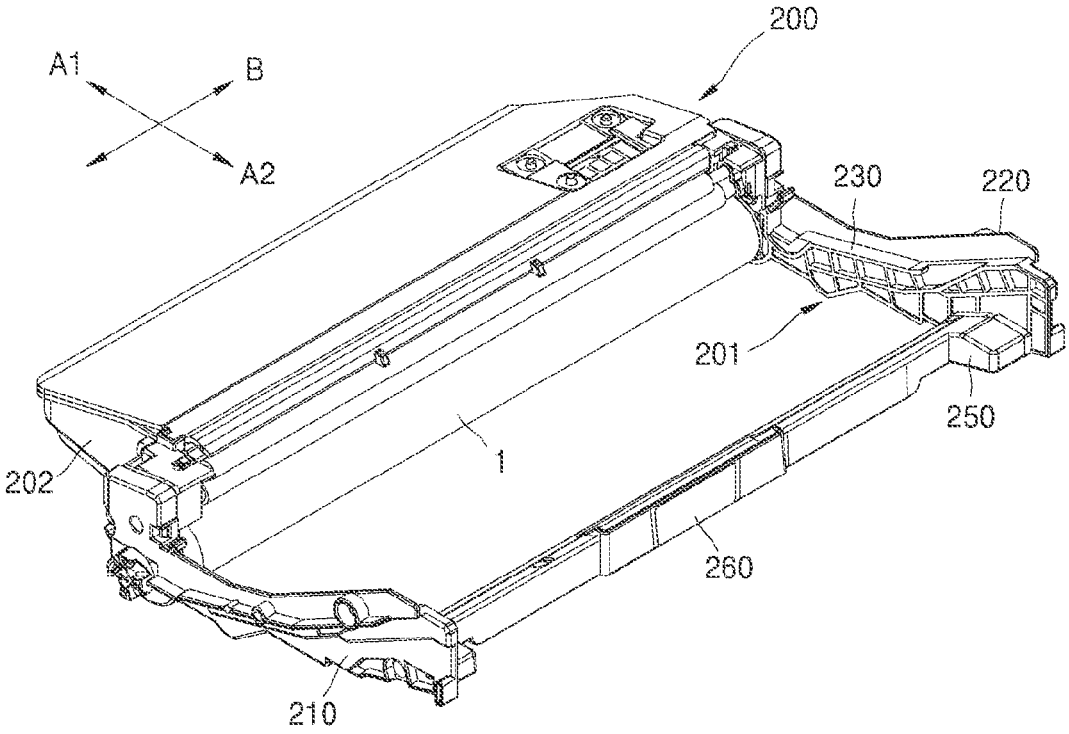
FIG. 4 is a perspective view of a photoreceptor cartridge according to an embodiment of the present invention.
Figure 5:
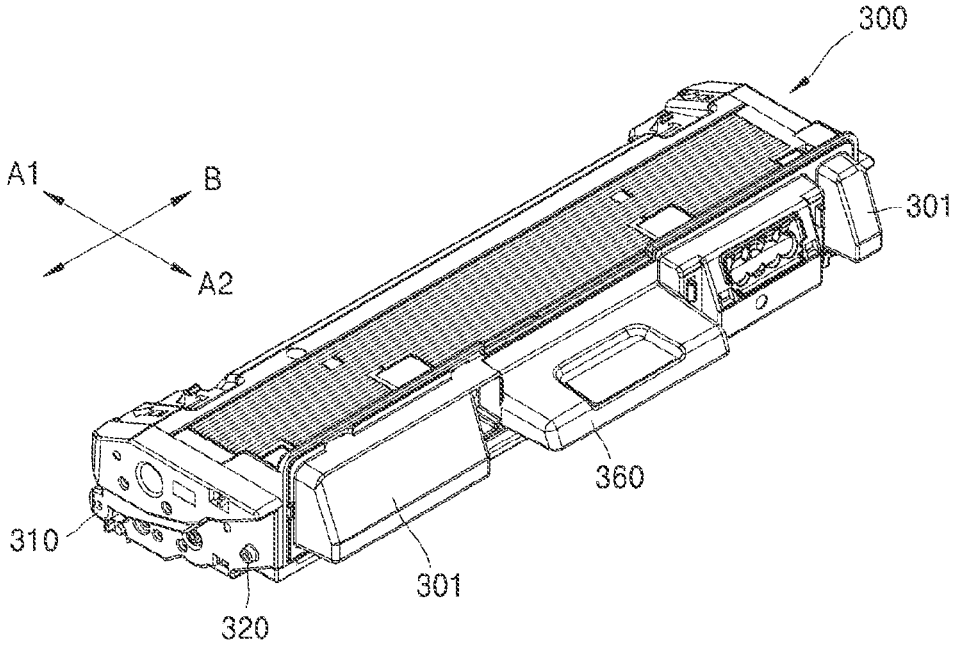
FIG. 5 is a perspective view of a development cartridge according to an embodiment of the present invention.

FIG. 4 is a perspective view of the photoreceptor cartridge 200 according to an embodiment of the present invention. FIG. 5 is a perspective view of the development cartridge 300 according to an embodiment of the present invention. Referring to FIGS. 4 and 5, the photoreceptor cartridge 200 includes the mounting portion 201 where the development cartridge 300 is mounted. The mounting portion 201 may include, for example, first and second guide members 210 and 220 extending backwards respectively from both side portions of a frame 202 of the photoreceptor cartridge 200. The first and second guide members 210 and 220 may be connected to each other by a connecting member 250 extending in a length direction B of the photoconductive drum 1. The connecting member 250 may be connected to rear ends of the first and second guide members 210 and 220. Guide rails 230 may be provided at inner walls of the first and second guide members 210 and 220. First and second guide protrusions 310 and 320 may be provided respectively on both side portions of the development cartridge 300. The second guide protrusion 320 may be disposed at a location spaced apart from the first guide protrusion 310 in backwards. The development cartridge 300 may be mounted in or removed from the mounting portion 201 as the first and second guide protrusions 310 and 320 are supported by the guide rail 230.

Figure 6:
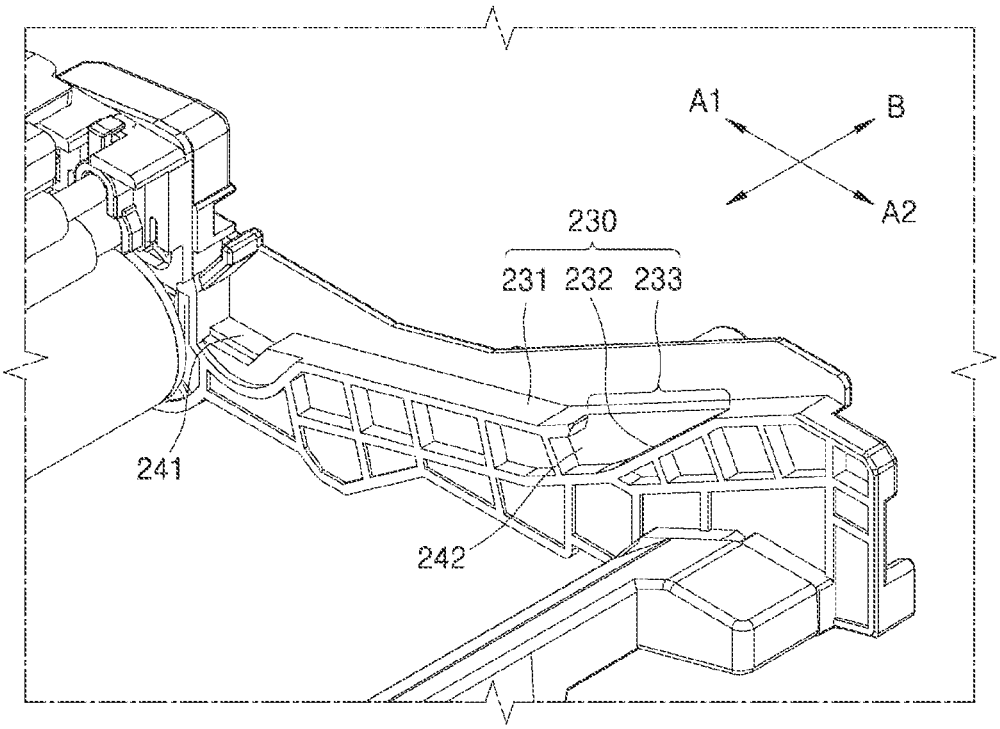
FIG. 6 is a perspective view of a guide rail according to an embodiment of the present invention.

FIG. 6 is a perspective view of the guide rail 230, according to an embodiment of the present invention. Referring to FIG. 6, the guide rail 230 guides the first and second guide protrusions 310 and 320 respectively to first and second accommodation portions 241 and 242. The guide rail 230 may have a rib shape protruding inward from the inner walls of the first and second guide members 210 and 220. The first and second guide protrusions 310 and 320 may have a boss shape externally protruding respectively from the both side portions of the development cartridge 300. The guide rail 230 may include a first guide rail 231 for guiding the first guide protrusion 310 to the first accommodation portion 241, and a second guide rail 232 for guiding the second guide protrusion 320 to the second accommodation portion 242. The second guide rail 232 may be branched from the first guide rail 231 and extends towards the second accommodation portion 242. A protrusion amount of the second guide protrusion 320 from a side wall of the development cartridge 300 may be smaller than a protrusion amount of the first guide protrusion 310. The protrusion amount of the first guide rail 231 from the inner wall of the first and second guide members 210 and 220 near a branching location 233 where the second guide rail 232 may be branched from the first guide rail 231 may be smaller than that of the second guide rail 232. Accordingly, the first guide protrusion 310 may be continuously guided by the first guide rail 231 by passing through the branching location 233, whereas the second guide protrusion 320 deviates from the first guide rail 231 and is guided by the second guide rail 232 while passing through the branching location 233. The first accommodation portion 241 may have a shape, for example, a U- or V-shape, such that the first guide protrusion 310 having a cylindrical shape may be inserted and accommodated therein. The second accommodation portion 242 may have a shape, for example, a lying U- or V-shape, such that the second guide protrusion 320 having a cylindrical shape is inserted and accommodated therein and does not leave from the second accommodation portion 242 upwardly. However, the shapes of the first and second accommodation portions 241 and 242 are not limited thereto.

Figure 7A:
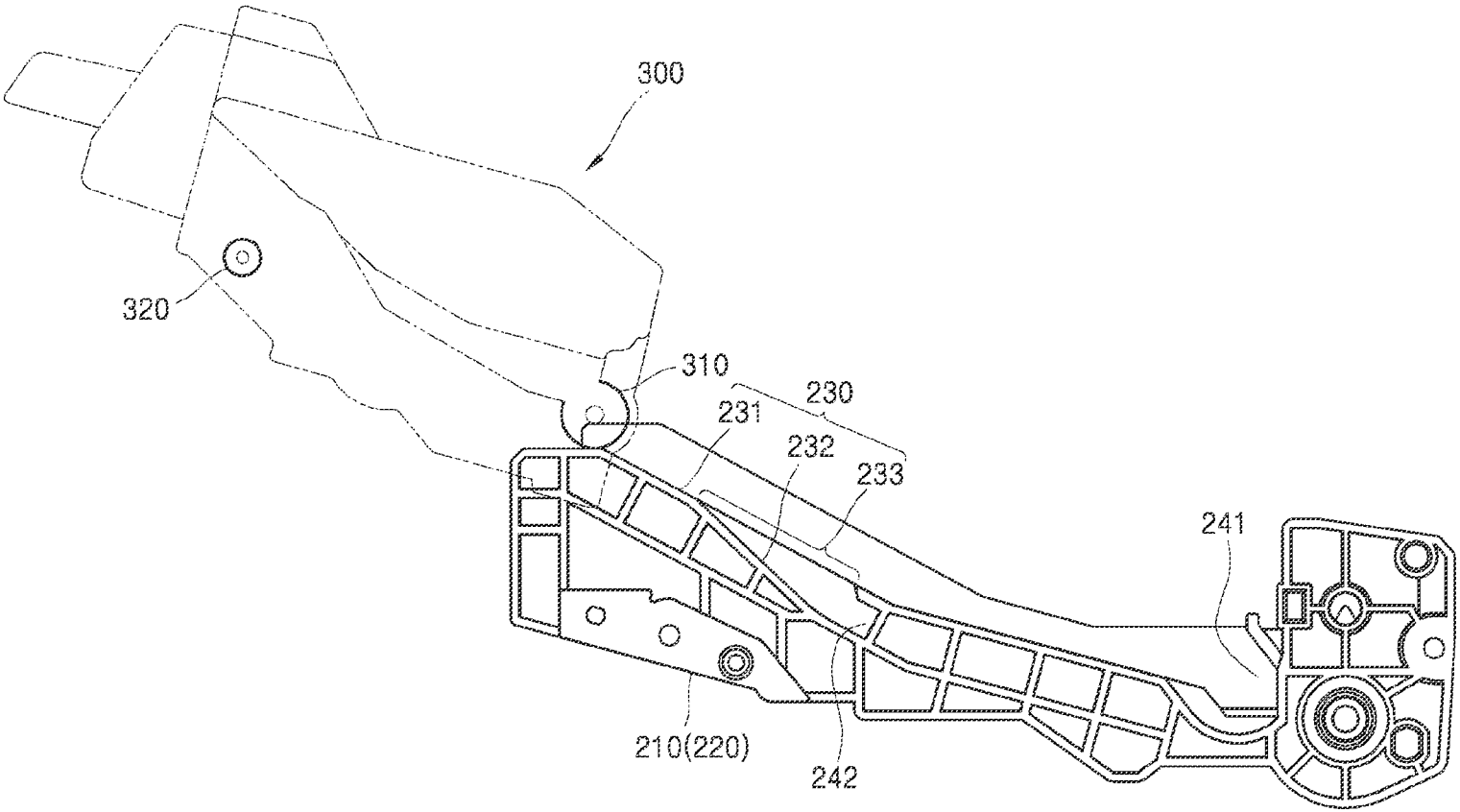
FIGS. 7A through 7C are schematic views illustrating an exemplary process of mounting a development cartridge in a mounting portion after a photoreceptor cartridge is mounted in a body, according to an embodiment of the present invention.
Figure 7B:
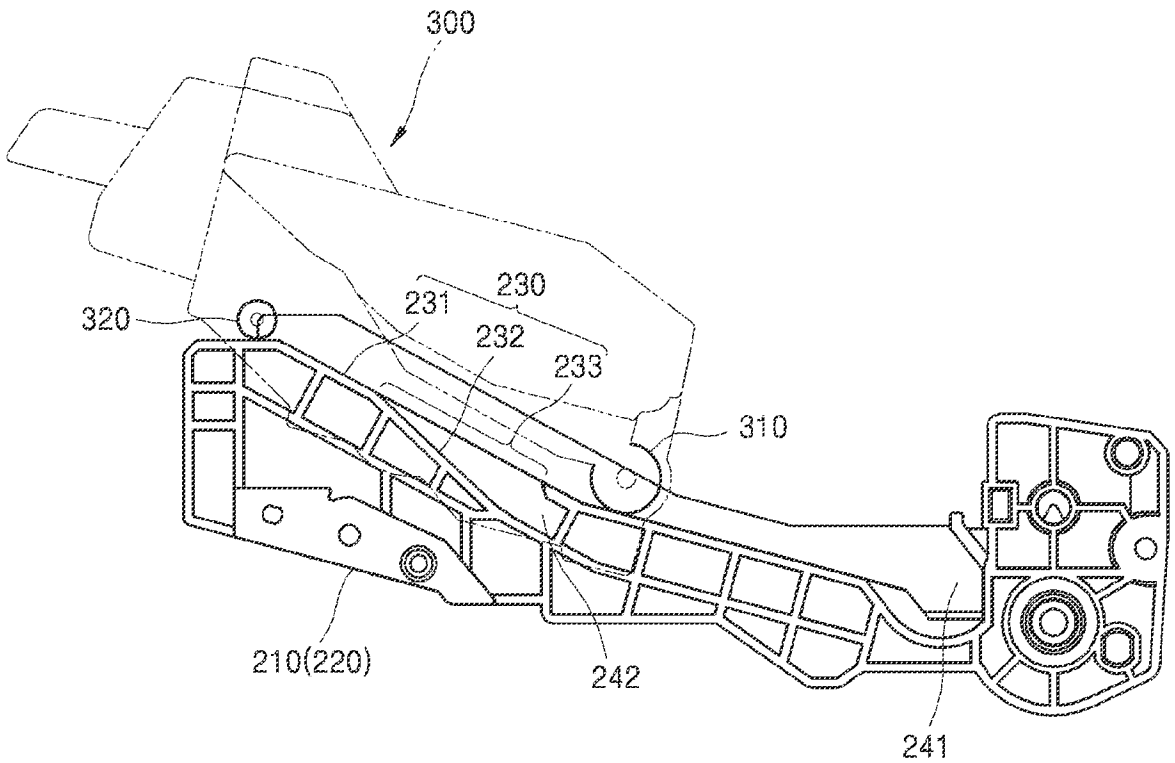
Figure 7C:
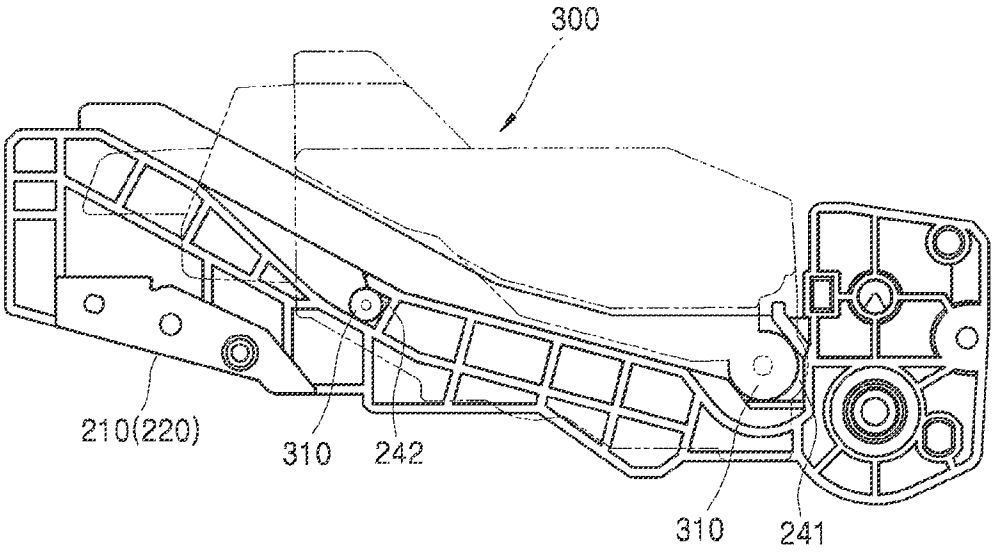

FIGS. 7A through 7C are schematic views illustrating an exemplary process of mounting the development cartridge 300 in the mounting portion 201 after the photoreceptor cartridge 200 is mounted in the body 100, according to an embodiment of the present invention. While the photoreceptor cartridge 200 is mounted in the body 100, the development cartridge 300 is drawn near the body 100 as illustrated in FIG. 7A so that the first guide protrusion 310 is supported by the first guide rail 231. The development cartridge 300 may be pushed into the body 100. The first guide protrusion 310 approaches the first accommodation portion 241 by being guided by the first guide rail 231 over the branching location 233. As the development cartridge 300 is inserted into the body 100, the second guide protrusion 320 may begin to be guided by the first guide rail 231. Since the protrusion amount of the second guide protrusion 320 is smaller than the first guide protrusion 310, when the second guide protrusion 320 reaches the branching location 233, the second guide protrusion 320 is separated from the first guide rail 231 and is guided by the second guide rail 232 as illustrated in FIG. 7B. When the development cartridge 300 is continuously inserted into the body 100, the first and second guide protrusions 310 and 320 are respectively guided by the first and second guide rails 231 and 232 and accommodated in the first and second accommodation portions 241 and 242 as illustrated in FIG. 7C.

When attaching/detaching directions of the development cartridge 300 and the photoreceptor cartridge 200 cross a transfer direction of the recording medium P, e.g., are a length direction of the photoconductive drum 1, the photoconductive drum 1 and the development roller 4 may interfere with other components in the body 100 or the development cartridge 300 and the photoconductive drum 1 may interfere with each other. Thus, a risk of the photoconductive drum 1 and/or the development roller 4 being damaged may be high, while the development cartridge 300 and the photoreceptor cartridge 200 are attached to, or detached from, the body 100. According to an electrophotographic image forming apparatus of an exemplary embodiment, the mounting direction A1 and the removal direction A2 of the photoreceptor cartridge 200 and the development cartridge 300 are the transfer direction of the recording medium P. That is, the mounting direction A1 and the removal direction A2 may be a transverse direction crossing the length direction B of the photoconductive drum 1. According to an exemplary embodiment, the development roller 4 and the photoconductive drum 1 may hardly interfere with each other while mounting the development cartridge 300 in the mounting portion 201. Accordingly, a risk of damage caused by interference between the development roller 4 and the photoconductive drum 1 may be reduced.

Even when the development cartridge 300 is mounted in the mounting portion 201 of the photoreceptor cartridge 200 after the photoreceptor cartridge 200 is mounted in the body 100, the development cartridge 300 is not fixedly combined to the photoreceptor cartridge 200. Accordingly, a user may remove the development cartridge 300 from the photoreceptor cartridge 200 and the body 100 by pulling the development cartridge 300 in a removal direction, without having to unlock the development cartridge 300 from the photoreceptor cartridge 200. According to an electrophotographic image forming apparatus of an exemplary embodiment, the development cartridge 300 is pressurized in the mounting direction by closing the cover 400, thereby fixing the development cartridge 300 to the photoreceptor cartridge 200.

Figure 8:
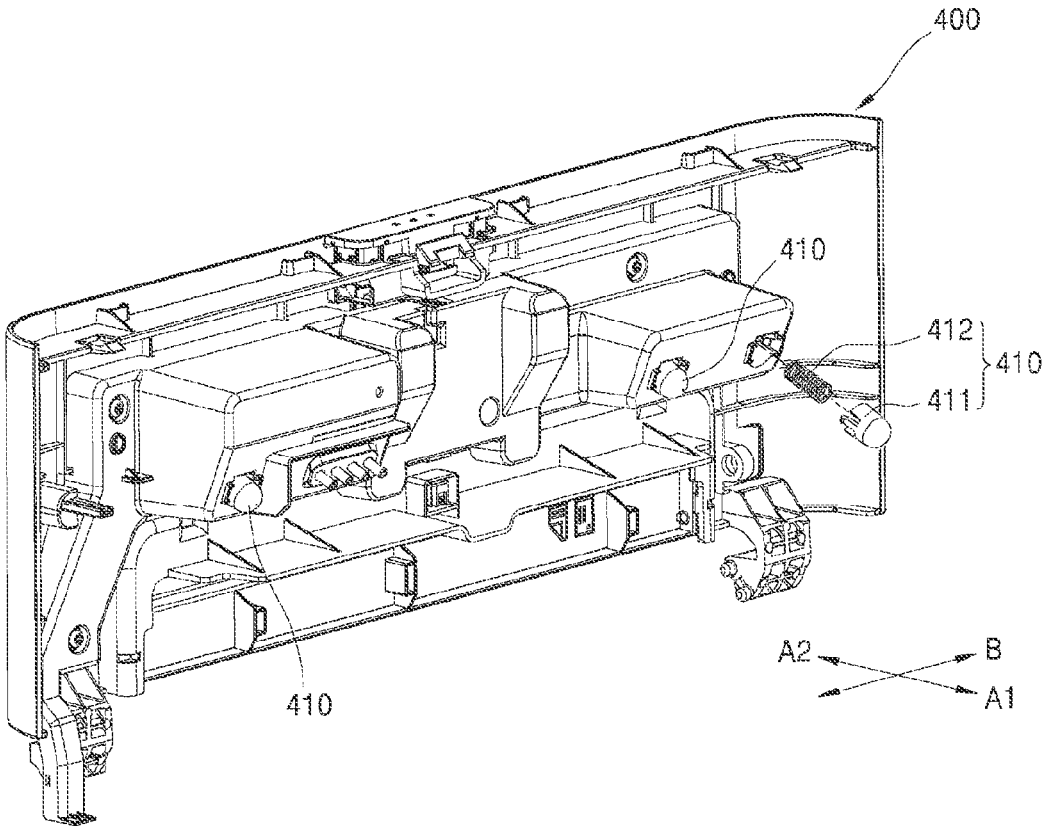
FIG. 8 is a perspective view of a cover according to an embodiment of the present invention.
Figure 9:
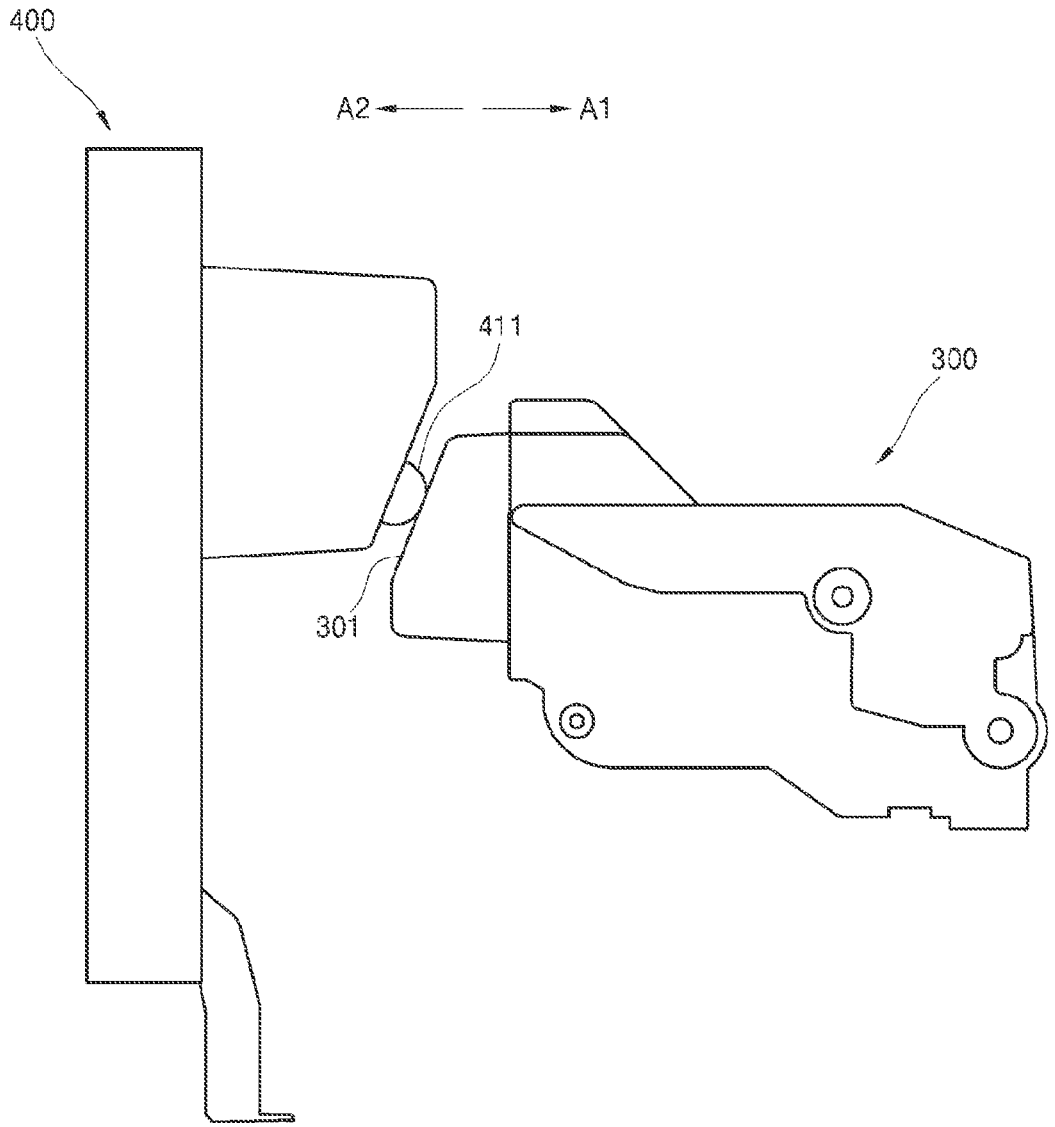
FIG. 9 illustrates an exemplary development cartridge being pressurized by a pressurization portion while a cover is closed, according to an embodiment of the present invention.

FIG. 8 is a perspective view of the cover 400 according to an embodiment of the present invention. FIG. 9 is a side view illustrating an exemplary development cartridge 300 being pressurized by a pressurization portion 410 while the cover 400 is closed, according to an embodiment of the present invention. Referring to FIG. 8, the cover 400 includes the pressurization portion 410. The pressurization portion 410 may include, for example, a pressurization member 411 for pressurizing the development cartridge 300, and an elastic member 412 for providing elastic force to the pressurization member 411 to push the development cartridge 300 in the mounting direction A1. The elastic member 412 may be a compressed coil spring. The pressurization member 411 may push a rear surface of the development cartridge 300. For example, referring to FIGS. 4 and 9, a pressure-receiving portion 301 to which the pressurization member 411 contacts may be provided at a rear portion of the development cartridge 300. When the cover 400 is closed as illustrated in FIG. 9 after mounting the development cartridge 300 in the mounting portion 201 of the photoreceptor cartridge 200 mounted in the body 100, elastic force is applied to the development cartridge 300 in the mounting direction A1 by the pressurization portion 410. The development cartridge 300 may be pushed in the mounting direction A1 by the elastic force, and is stopped while the gap maintaining member 42*a* or 42*b* contacts the photoconductive drum 1 as illustrated in FIG. 3A or 3B. Since the first and second guide protrusions 310 and 320 may be respectively accommodated in the first and second accommodation portions 241 and 242 having the U- or V-shape, the first and second guide protrusions 310 and 320 do not deviate from the first and second accommodation portions 241 and 242 in a direction crossing the mounting direction A1 (a direction of the elastic force). Accordingly, the development cartridge 300 is fixed to the photoreceptor cartridge 200.

As such, by fixing the development cartridge 300 to the mounting portion 201 by closing the cover 400, a locking apparatus, or the like, for fixing the development cartridge 300 to the photoreceptor cartridge 200 does not need to be separately provided at the development cartridge 300 or the photoreceptor cartridge 200, and thus material costs may be reduced. Since the combination of the development cartridge 300 and the photoreceptor cartridge 200 may be maintained/released only by opening and closing the cover 400, processes of mounting/detaching the development cartridge 300 and the photoreceptor cartridge 200 may be simplified, and thus user convenience may be improved.

Referring to FIG. 4, a first handle 260 for the user to hold while mounting, or removing, the photoreceptor cartridge 200 in, or from, the body 100 may be provided in the photoreceptor cartridge 200. The first handle 260 may be located at the opening 101, i.e., at the rear of the photoreceptor cartridge 200, so as to be easily found by the user when the cover 400 is opened. For example, the first handle 260 may be provided at a center of the connecting member 250 connecting the first and second guide members 210 and 220.

Referring to FIG. 5, a second handle 360 for the user to hold while mounting, or removing, the development cartridge 300 in, or from, the body 100 may be provided in the development cartridge 300. The second handle 360 may be located at the opening 101, i.e., at the rear of the development cartridge 300 so as to be easily found by the user when the cover 400 is opened.

According to the electrophotographic image forming apparatus of an exemplary embodiment, when the photoreceptor cartridge 200 and the development cartridge 300 are removed from the body 100, the development cartridge 300 is removed from the mounting portion 201 of the photoreceptor cartridge 200, and the photoreceptor cartridge 200 is removed from the body 100. Referring to FIG. 2, the second handle 360 may be located above the first handle 260 while the photoreceptor cartridge 200 and the development cartridge 300 are mounted in the body 100. An eye level of the user is usually higher than the electrophotographic image forming apparatus. A line of sight of the user looking into the body 100 through the opening 101 while the cover 400 of the body 100 is opened may be from top to bottom. Thus, a location of the second handle 360 above the first handle 260 may be more easily found by the user, and the user may first hold the second handle 360 and remove the development cartridge 300. Alternatively, the second handle 360 may protrude further towards the opening 101 than the first handle 260. Accordingly, the first handle 260 may be disposed below the second handle 360 and is located more inside the body 100 than the second handle 360. Considering the line of sight of the user looking from top to bottom, the user may easily finds the second handle 360. The first handle 260 may be hidden by the second handle 360 and thus may not easily be found by the user when the development cartridge 300 is not removed. Accordingly, the user may remove the development cartridge 300 first.

Driving members such as the photoconductive drum 1 and the charging roller 2 provided in the photoreceptor cartridge 200, and the development roller 4, the supply roller 6, and the agitators 7*a* and 7*b* provided in the development cartridge 300 may be rotated by receiving driving power from a driving unit (not shown) provided in the body 100, when the photoreceptor cartridge 200 and the development cartridge 300 are mounted in the body 100.

A driving structure, in which the photoreceptor cartridge 200 and the development cartridge 300 may be individually connected to the driving unit of the body 100, may be used. According to an electrophotographic image forming apparatus of an exemplary embodiment, the development cartridge 300 is mounted in the mounting portion 201 provided in the photoreceptor cartridge 200. The mounting location of the development cartridge 300 in the body 100 may e triply constrained by a location relationship between the photoreceptor cartridge 200 and the body 100, a location relationship between the development cartridge 300 and the mounting portion 201, and a location relationship between the development cartridge 300 and the driving unit provided in the body 100. In other words, the mounting location of the development cartridge 300 in the body 100 may be over-constrained. Accordingly, when any one of the location relationships is not stable, the mounting location of the development cartridge 300 in the body 100 is unstable, and thus the development cartridge 300 may be twisted or vibrated when the development roller 4 is driven. The twisting or vibrating of the development cartridge 300 may result, for example, toner leakage. In a contact development method, the development roller 4 and the photoconductive drum 1 may not stably contact each other, and in the non-contact development method, an interval between the development roller 4 and the photoconductive drum 1 may not be uniformly maintained. Such an unstable location relationship between the photoconductive drum 1 and the development roller 4 may cause an image defect, such as an image omission or uneven image concentration. Since two driving couplers may be required in the body 100 to transfer driving power to the photoreceptor cartridge 200 and the development cartridge 300, a driving structure becomes complex and the number of components are increased, thereby increasing material costs, assembly costs, and a size of the electrophotographic image forming apparatus.

According to an electrophotographic image forming apparatus of an exemplary embodiment, the driving power of the driving unit provided in the body 100 is transferred to the photoreceptor cartridge 200 and the development cartridge 300 along a path of the body 100, the photoreceptor cartridge 200, and the development cartridge 300.

Referring to FIGS. 2 and 4, the photoreceptor cartridge 200 may be mounted in the body 100 by being guided by a mounting rail 108 provided in the body 100. A first coupler 160 may be provided in the body 100. The first coupler 160 may be provided in one or both side portions of the body 100. The first coupler 160 may be driven by a driving motor 170 of FIG. 12 provided in the body 100. A second coupler 280 may be provided in one or both side portions of the photoreceptor cartridge 200. The second coupler 280 may be provided at a rotation shaft of the photoconductive drum 1 so that rotation power of the second coupler 280 is directly transferred to the photoconductive drum 1. An exemplary embodiment of the present invention is not limited thereto, and the second coupler 280 may be connected to the photoconductive drum 1 by a gear train (not shown) provided at the photoreceptor cartridge 200. When the photoreceptor cartridge 200 is mounted in the body 100, driving power may be transferred from the body 100 to the photoreceptor cartridge 200 as the first and second couplers 160 and 280 are engaged with each other. Although not illustrated, the charging roller 2 may be connected to the second coupler 280 directly or according to gear connection with a first gear 12 of FIG. 11 provided in the rotation shaft of the photoconductive drum 1.

Figure 10:
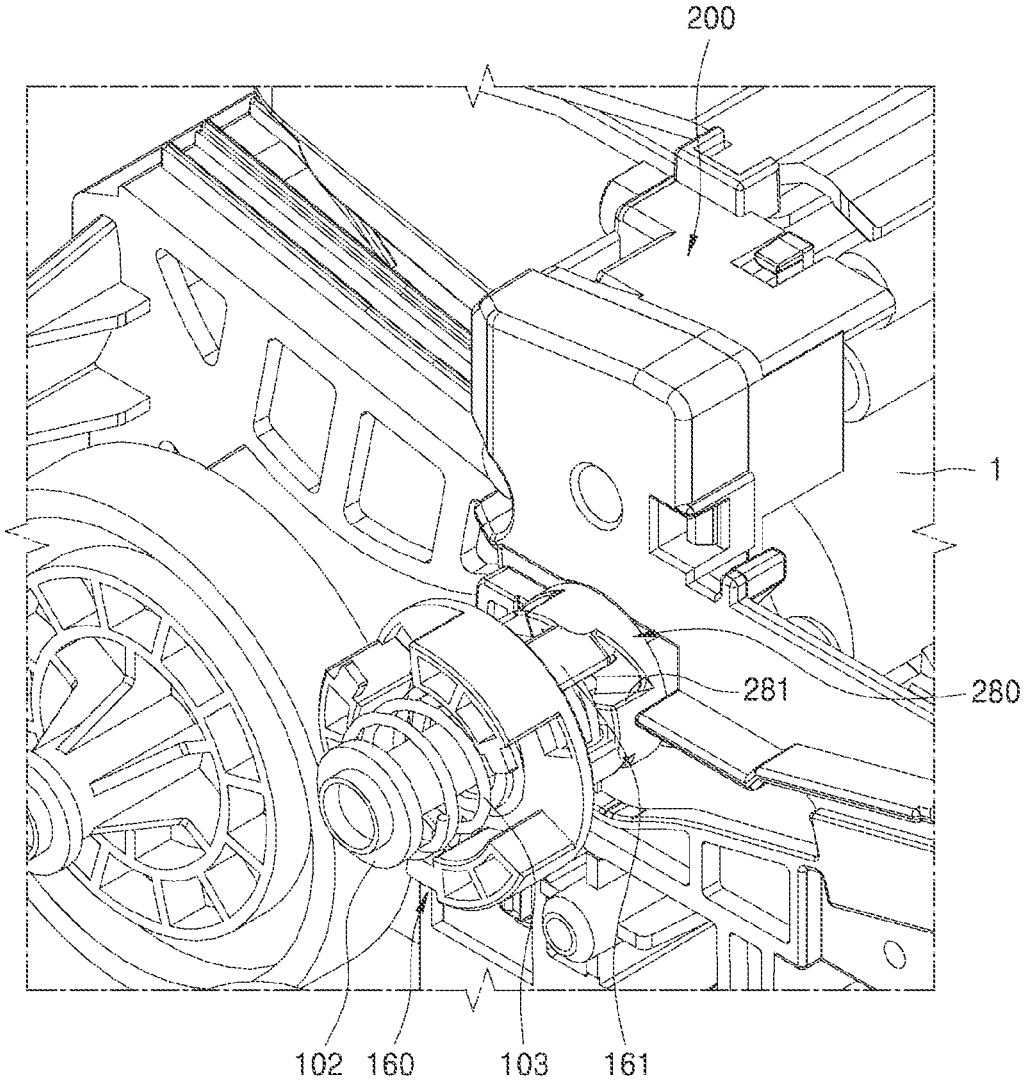
FIG. 10 is a perspective view of first and second couplers, according to an embodiment of the present invention.

FIG. 10 is a perspective view of the first and second couplers 160 and 280, according to an embodiment of the present invention. Referring to FIG. 10, first and second combining portions 161 and 281 having complementary shapes may be respectively provided in the first and second couplers 160 and 280. For example, the first combining portion 161 may have a protruding shape and the second combining portion 281 may have a concave shape to be engaged with a plurality of protrusions. The shapes of the first and second combining portions 161 and 281 are not limited as long as the first and second combining portions 161 and 281 may be engaged to transfer rotational movement of the first coupler 160 to the second coupler 280, and are not limited by those illustrated in FIG. 10.

The first coupler 160 may be supported by a shaft 102 provided in the body 100 so as to move in the axial direction. A spring 103 may apply elastic force to the first coupler 160 in the direction where the first and second combining portions 161 and 281 are combined. The structures of the first and second couplers 160 and 280 are not limited to those illustrated in FIG. 10. Any one of various power connecting structure, such as gear-gear engaging structure may be employed as the first and second couplers 160 and 280.

Figure 11:
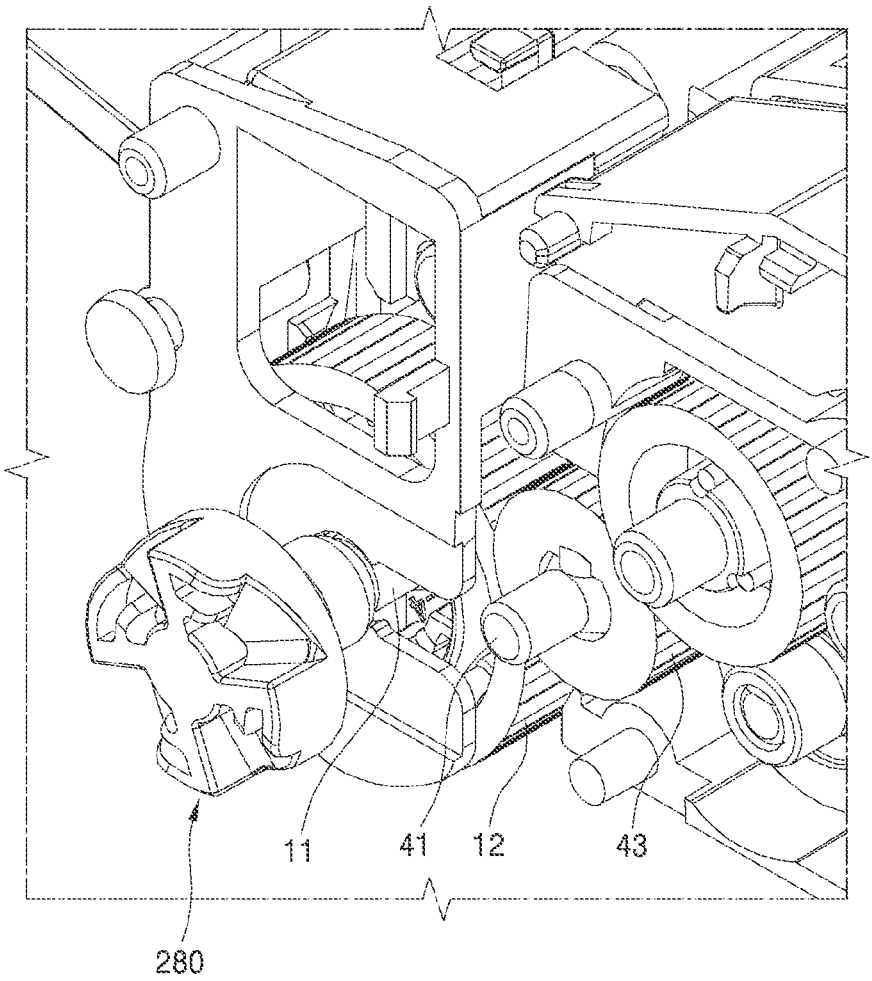
FIG. 11 is a perspective view of a power connecting structure of a photoreceptor cartridge and a development cartridge, according to an embodiment of the present invention.
Figure 12:
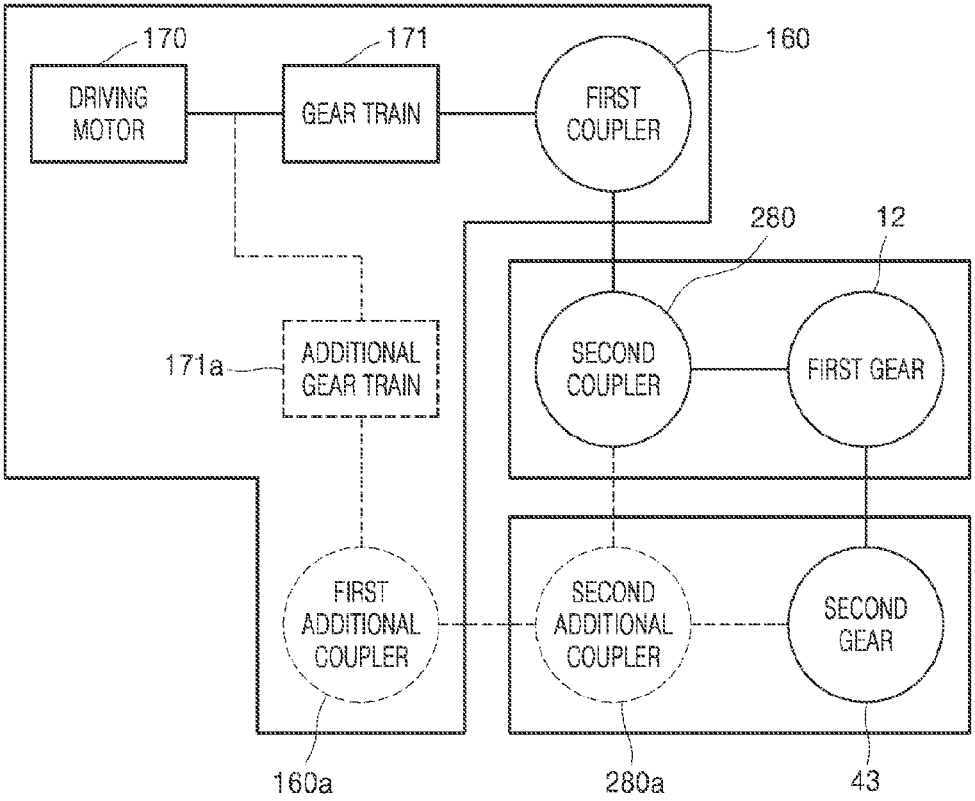
FIG. 12 is a schematic view of an exemplary power transfer structure of a body-photoreceptor cartridge-development cartridge.

FIG. 11 is a perspective view of a power connecting structure of the photoreceptor cartridge 200 and the development cartridge 300, according to an embodiment of the present invention. Referring to FIG. 11, the second coupler 280 may be provided at a rotation shaft 11 of the photoconductive drum 1. The first gear 12 may be provided at the rotation shaft 11 of the photoconductive drum 1. A second gear 43 may be provided at the rotation shaft 41 of the development roller 4. When the development cartridge 300 is mounted in the photoreceptor cartridge 200, the first and second gears 12 and 43 engage with each other. The supply roller 6 and the agitator 7 may be driven via gear connection with the second gear 43. Accordingly, driving power may be transferred from the photoreceptor cartridge 200 to the development cartridge 300.

FIG. 12 is a schematic view of a power transfer structure of the body 100, the photoreceptor cartridge 200, and the development cartridge 300. Referring to FIG. 12, the electrophotographic image forming apparatus according to an exemplary embodiment has a serial power transfer structure of the driving motor 170 included in the body 100, a gear train 171, the first coupler 160, the first gear 12, and the second gear 43. In other words, according to the electrophotographic image forming apparatus of the current embodiment, the driving power is transmitted from the body 100 to the photoreceptor cartridge 200 as the first and second couplers 160 and 280 are connected to each other. The development cartridge 300 is not directly connected to the body 100, and the driving power is transmitted from the photoreceptor cartridge 200 to the development cartridge 300 as the first and second gears 12 and 43 are connected to each other. The power transfer structure between the photoreceptor cartridge 200 and the body 100 may be only affected by the location relationship between the photoreceptor cartridge 200 and the body 100. The power transfer structure for transmitting the driving power to the development cartridge 300 may not be affected by the location relationship between the development cartridge 300 and the body 100, and may be only affected by the location relationship between the photoreceptor cartridge 200 and the development cartridge 300. Accordingly, the driving power may be stably transmitted to the development cartridge 300 by suitably constraining a mounting location of the development cartridge 300 on the photoreceptor cartridge 200. In addition, material costs and assembly costs may be reduced since a number of components for power transmission may be reduced.

According to an exemplary structure of individual power connection of the development cartridge 300 to the body 100, the development cartridge 300 may include a first additional coupler **280*a* and the body 100 may include an additional gear train 171 a and a first additional coupler 160*a* for power connection between the driving motor 170 and the second additional coupler 280*a*** as denoted by broken lines. Accordingly, the power transfer structure may be complex, and the material costs and assembly costs may be increased.

Figure 13:
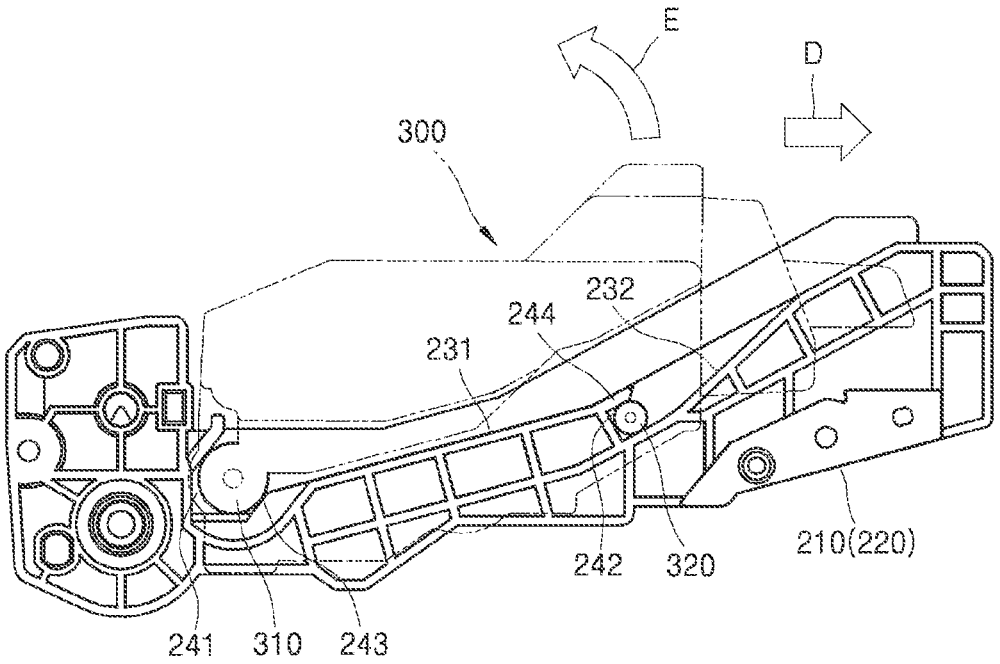
FIG. 13 is a view illustrating an exemplary relationship between first and second guide protrusions and first and second accommodation portions while a development cartridge is mounted in a photoreceptor cartridge.

FIG. 13 is a view for describing an exemplary relationship between the first and second guide protrusions 310 and 320 and the first and second accommodation portions 241 and 242 while the development cartridge 300 is mounted in the photoreceptor cartridge 200. Referring to FIG. 13, when the development cartridge 300 is mounted in the photoreceptor cartridge 200, the first and second guide protrusions 310 and 320 are located in the first and second accommodation portions 241 and 242. When the cover 400 is closed, the development cartridge 300 may be pushed in the mounting direction A1 by the pressurization portion 410 and thus the development roller 4 and the photoconductive drum 1 reach the locations illustrated in FIG. 3A or 3B, and the development cartridge 300 no longer moves in the mounting direction A1.

The development roller 4 rotates as the second gear 43 provided at the rotation shaft of the development roller 4 and the first gear 12 provided at the rotation shaft of the photoconductive drum 1 are engaged. The development cartridge 300 may be pushed in a direction indicated by an arrow D of FIG. 13 by the rotational force for rotating the development roller 4. The pushing out (retreating) of the development cartridge 300 causes an engage amount of the first and second gears 12 and 43 to be reduced, a contact amount of the development roller 4 and the photoconductive drum 1 to be reduced when the contact development method is used, and the interval between the development roller 4 and the photoconductive drum 1 to be increased when the non-contact development method is used. As a result, an image omission or an image defect caused by faulty rotation of the development roller 4 may be generated. According to an exemplary embodiment, in order to prevent the development cartridge 300 from being pushed, the first accommodation portion 241 may include a retreat preventing portion 243 located at, for example, at the rear portion of the first guide protrusion 310 to support the first guide protrusion 310.

Figure 14:
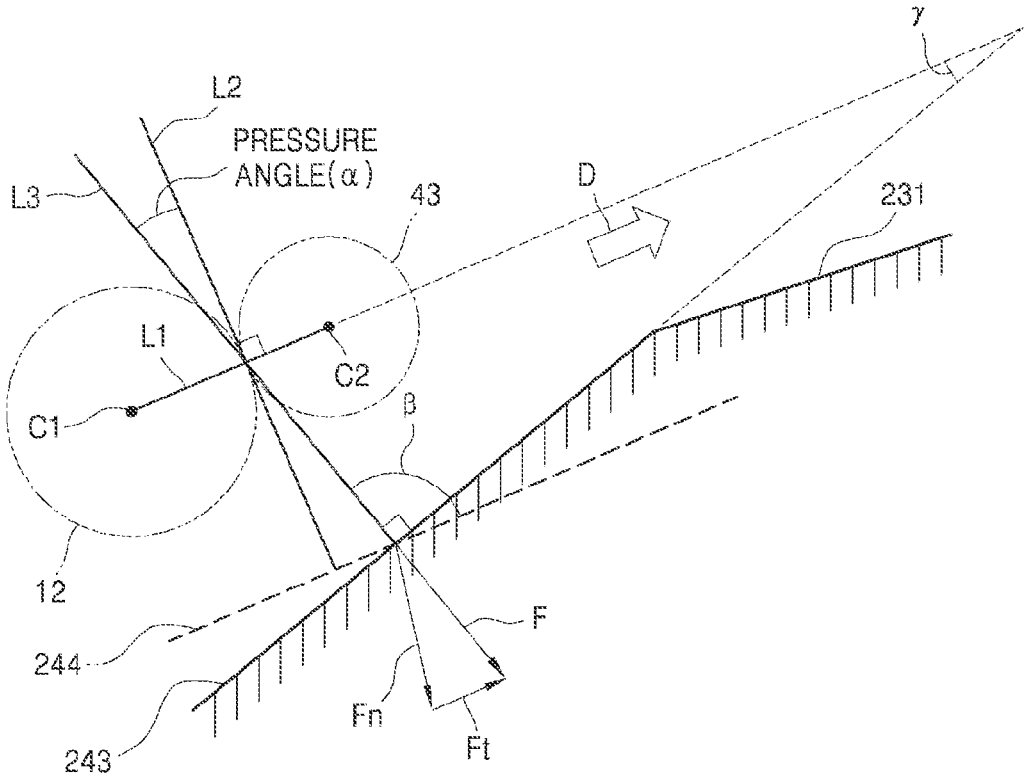
FIGS. 14 and 15 are diagrams illustrating an exemplary angle relationship between a line connecting centers of a photoconductive drum and a development roller, and a retreat preventing portion.

Referring to FIGS. 11, 13, and 14, a line L1 connecting a center C1 of the first gear 12 and a center C2 of the second gear 43, and a line L2 perpendicular to the line L1 are illustrated. A direction of a force F applied to the first gear 12 as the first gear 12 is rotated is same as a line L3 tilted by a pressure angle α of the first and second gears 12 and 43 with respect to the line L2. Since the first guide protrusion 310 is supported by the retreat preventing portion 243, when the first and second gears 12 and 43 are rotated, the force F is applied to the retreat preventing portion 243 by the first guide protrusion 310.

Figure 15:
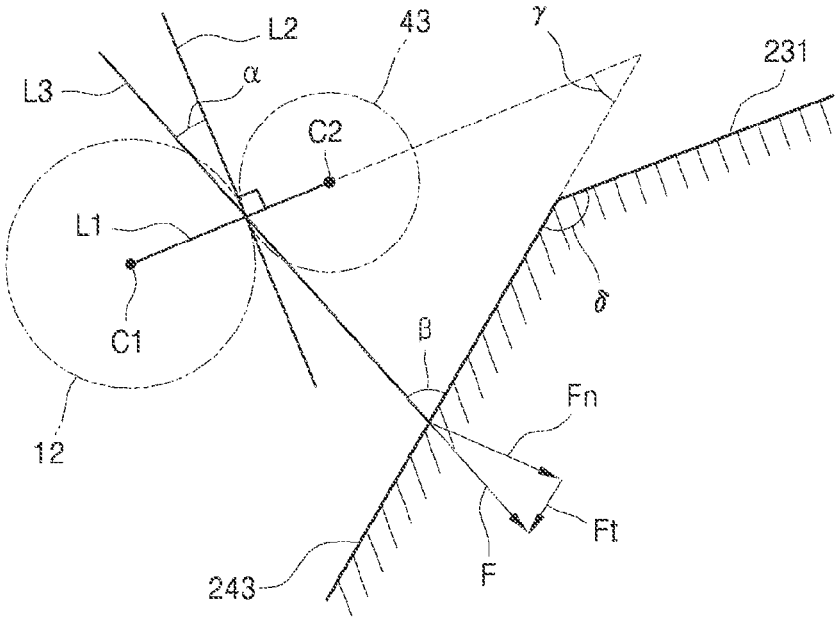

As illustrated by solid lines in FIG. 14, when an angle formed by the retreat preventing portion 243 and the force F is 90°, the development cartridge theoretically does not retreat. At this time, an angle formed by the retreat preventing portion 243 and the line L1 is equal to the pressure angle α. However, the development cartridge 300 may immediately retreat even when a small imbalance or a small vibration is generated while operating the development cartridge 300. If the angle formed by the retreat preventing portion 243 and the force F is not 90°, the force F may be divided into a component force Fn perpendicular to the retreat preventing portion 243 and a component force Ft extending from the retreat preventing portion 243. As denoted by dashed line 244 in FIG. 14, when an angle β formed by the retreat preventing portion 243 and the force F is an obtuse angle, a direction of the component force Ft is a direction in which the development cartridge 300 may be retreated. In other words, the development cartridge 300 is pushed in the direction indicated by the arrow D along the extending direction 244 of the retreat preventing portion 243 by the component force Ft. Accordingly, the retreat preventing portion 243 may be unable to prevent the development cartridge 300 from retreating. Referring to FIG. 15, when the angle β formed by the retreat preventing portion 243 and the force F is an acute angle, the direction of the component force Ft is a direction in which the development cartridge 300 may be advanced. The development cartridge 300 may be maintained in the mounting portion 201 while the gap maintaining members 42*a* or 42*b* contacts the photoconductive drum 1, according to the component force Ft. Accordingly, the development cartridge 300 may be prevented from retreating, and the engage amount of the first and second gears 12 and 43 and the contact amount or gap between the development roller 4 and the photoconductive drum 1 may be maintained.

When an angle formed by the line L3 and the retreat preventing portion 243 is 90°, an angle γ formed by the line L1 and the retreat preventing portion 243 is equal to the pressure angle α. As illustrated in FIG. 15, the angle β formed by the line L3 and the retreat preventing portion 243 may be an acute angle. The angle γ formed by the line L1 and the retreat preventing portion 243 is an acute angle. Accordingly, by setting the angle γ formed by the line L1 connecting the centers C1 and C2 of the first and second gears 12 and 43 and the retreat preventing portion 243 to be an acute angle larger than the pressure angle α, the retreating of the development cartridge 300 caused by the rotational force of the first and second gears 12 and 43 may be effectively prevented. An angle δ formed by the retreat preventing portion 243 and the guide rail 230 may be an obtuse angle smaller than 180° so that the first guide protrusion 310 easily deviates from the first accommodation portion 241 when the development cartridge 300 is separated from the photoreceptor cartridge 200.

Referring to FIG. 13, the second guide protrusion 320 may be located in the second accommodation portion 242. When the first and second gears 12 and 43 rotate, rotational force is applied to the development cartridge 300 in a direction indicated by an arrow E. In order to prevent the development cartridge 300 from rotating, the second accommodation portion 242 includes a rotation preventing portion 244 supporting the second guide protrusion 320 by being located at a downstream of the second guide protrusion 320 in the rotation direction of the first gear (or the development roller 4). Accordingly, the development cartridge 300 may maintain a stable position without being retreated or rotated while the development roller 4 rotates, and a relative location of the photoconductive drum 1 and the development roller 4 may be stably maintained.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic image forming apparatus comprising:

a body comprising an opening and a first coupler;

a photoreceptor cartridge comprising a second coupler connected to the first coupler, a first gear connected to the second coupler, and a mounting portion, and attached to or detached from the body through the opening;

a development cartridge comprising a second gear connected to the first gear, and attached to or detached from the mounting portion through the opening in a state where the photoreceptor cartridge is mounted in the body;

a first guide protrusion disposed on both side portions of the development cartridge; and a first accommodation portion provided at the photoreceptor cartridge and in which the first guide protrusion is accommodated, wherein the first accommodation portion comprises a retreat preventing portion disposed at a removal direction of the first guide protrusion and supporting the first guide protrusion, and wherein an angle formed by the retreat preventing portion and a line connecting centers of the first and second gears is larger than a pressure angle of the first and second gears.

2. The electrophotographic image forming apparatus of claim 1, wherein the photoreceptor cartridge comprises a photoconductive drum on which an electrostatic latent image is formed, and the development cartridge comprises a development roller for supplying toner included therein to the electrostatic latent image formed on the photoconductive drum.

3. The electrophotographic image forming apparatus of claim 2, wherein mounting and removing directions of the photoreceptor cartridge and the development cartridge are transverse directions crossing a length direction of the photoconductive drum.

4. The electrophotographic image forming apparatus of claim 2, wherein the first coupler and the first gear are provided at a rotation shaft of the photoconductive drum.

5. The electrophotographic image forming apparatus of claim 4, wherein the second gear is provided at a rotation shaft of the development roller.

6. The electrophotographic image forming apparatus of claim 1, wherein the angle formed by the retreat preventing portion and the line connecting the centers of the first and second gears is smaller than 90°.

7. The electrophotographic image forming apparatus of claim 1, further comprising a first guide rail provided at the photoreceptor cartridge and guiding the first guide protrusion to the first accommodation portion, wherein an angle formed by the retreat preventing portion and the first guide rail is an obtuse angle smaller than 180°.

8. The electrophotographic image forming apparatus of claim 1, further comprising:

a second guide protrusion disposed at both side portions of the development cartridge; and a second accommodation portion provided at the photoreceptor cartridge and in which the second guide protrusion is accommodated, wherein the second accommodation portion comprises a rotation preventing portion for supporting the second guide protrusion by being disposed at a downstream of a rotation direction of the first gear based on the second guide protrusion.

9. The electrophotographic image forming apparatus of claim 8, further comprising a second guide rail for guiding the second guide protrusion to the second accommodation portion.

10. An electrophotographic image forming apparatus comprising:

a body comprising an opening;

a photoreceptor cartridge attached to or detached from the body through the opening, and comprising a photoconductive drum and a mounting portion;

a development cartridge attached to or detached from the mounting portion through the opening in a state where the photoreceptor cartridge is mounted in the body, and comprising a development roller for supplying toner to an electrostatic latent image formed on the photoconductive drum;

a power connecting unit for sequentially connecting power from the body to the photoreceptor cartridge and the development cartridge, the power connecting unit comprising:

a first gear provided at the photoreceptor cartridge, a second gear provided at the development cartridge and connected to the first gear when the development cartridge is mounted in the mounting portion;

a first guide protrusion disposed on both side portions of the development cartridge; and a first accommodation portion provided at the photoreceptor cartridge and in which the first guide protrusion is accommodated, wherein the first accommodation portion comprises a retreat preventing portion disposed at a removal direction of the first guide protrusion and supporting the first guide protrusion, and wherein an angle formed by the retreat preventing portion and a line connecting centers of the first and second gears is larger than a pressure angle of the first and second gears.

11. The electrophotographic image forming apparatus of claim 10, wherein the power connecting unit comprises:

a first coupler provided at the body; and a second coupler provided at the photoreceptor cartridge, and connected to the first coupler when the photoreceptor cartridge is mounted in the body, wherein the first gear is connected to the second coupler.

12. The electrophotographic image forming apparatus of claim 11, wherein the first coupler and the first gear are provided at a rotation shaft of the photoconductive drum, and the second gear is provided at a rotation shaft of the development roller.

13. The electrophotographic image forming apparatus of claim 10, further comprising a first guide rail provided at the photoreceptor cartridge and guiding the first guide protrusion to the first accommodation portion, wherein an angle formed by the retreat preventing portion and the first guide rail is an obtuse angle smaller than 180°.

14. The electrophotographic image forming apparatus of claim 13, further comprising:

a second guide protrusion provided at both side portions of the development cartridge; and a second accommodation portion provided at the photoreceptor cartridge and in which the second guide protrusion is accommodated, wherein the second accommodation portion comprises a rotation preventing portion supporting the second guide protrusion by being disposed at a downstream of a rotation direction of the first gear based on the second guide protrusion.

15. A cartridge for an apparatus having a first coupler, the cartridge comprising:

a photoreceptor cartridge comprising a second coupler connectable to the first coupler, a first gear connected to the second coupler, and a mounting portion, and attachable or detachable to the apparatus through an opening in apparatus;

a development cartridge comprising a second gear connectable to the first gear, and attachable or detachable from the mounting portion through the opening in a state where the cartridge is mounted in the apparatus;

a first guide protrusion disposed on both side portions of the development cartridge; and a first accommodation portion provided at the photoreceptor cartridge and in which the first guide protrusion is accommodated, wherein the first accommodation portion comprises a retreat preventing portion disposed at a removal direction of the first guide protrusion and supporting the first guide protrusion, and wherein an angle formed by the retreat preventing portion and a line connecting centers of the first and second gears is larger than a pressure angle of the first and second gears.

* * * * *